US005718184A

United States Patent [19]

Holland

[11] Patent Number: 5,718,184

[45] Date of Patent: Feb. 17, 1998

[54] HYDRO-LIFT BOAT HULL

[76] Inventor: Herbert A. Holland, P.O. Box 393, Campbell River BC, Canada, V9W 5B6

[21] Appl. No.: 754,786

[22] Filed: Nov. 21, 1996

[51] Int. Cl.[6] ..... B63B 1/00

[52] U.S. Cl. ..... 114/271; 114/62

[58] Field of Search ..... 114/271, 288–291, 114/56, 62; D12/310

[56] References Cited

U.S. PATENT DOCUMENTS

| | | | |
|---|---|---|---|
| D. 160,027 | 9/1950 | Smith | D12/310 |
| 2,938,490 | 5/1960 | Martin | 114/56 |
| 3,077,172 | 2/1963 | Dornak | 114/62 |
| 5,476,061 | 12/1995 | Ackerbloom | 114/290 |

*Primary Examiner*—Ed L. Swinehart

[57] ABSTRACT

A new Hydro-Lift Boat Hull for offering greater stability and higher speeds. The inventive device includes a keel portion having a keel channel provided therein, a pair of opposed chines positioned on opposite sides of the keel portion, a pair of angled panels symmetrically positioned about the keel portion intermediate the keel channel and the pair of opposed chines, and a pair of opposed gunwales extending upward from the pair of opposed chines, wherein each of the pair angled panels has a chine channel provided therein adjacent each of the pair opposed chines. The lower edge of each of the pair of angled panels extends into the water surface, whereby the pair of angled panels and the keel channel define a water capturing keel tunnel. The base portion of each of the pair of opposed chines extends into the water surface, whereby the pair of opposed chines and the chine channels define a pair of opposed water capturing chine tunnels. The water capturing keel tunnel and the pair of opposed water capturing chine tunnels capture water, compress the water, and form a keel "rail" of water and a pair of opposed chine "rails" of water, respectively, upon which the hull travels when the boat is operated.

14 Claims, 3 Drawing Sheets

10
11
12
20
22
23
24
30
32
40
41
42
44
45
46
50
60
70
5
6
7

13
22
23
30
32
40
41
42
44
45
50
60
70

HYDRO-LIFT BOAT HULL

BACKGROUND OF THE INVENTION

1. Field of the Invention

The present invention relates to boat hulls and more particularly pertains to a new Hydro-Lift Boat Hull for offering greater stability and higher speeds.

2. Description of the Prior Art

The use of boat hulls is known in the prior art. More specifically, boat hulls heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat hulls include U.S. Pat. No. 4,672,905; U.S. Pat. No. 4,722,294; U.S. Pat. No. 4,193,369; U.S. Pat. No. 5,199,373; U.S. Pat. No. 5,255,626 and U.S. Pat. No. 4,159,691.

While these devices fulfill their respective, particular objectives and requirements, the aforementioned patents do not disclose a new Hydro-Lift Boat Hull. The inventive device includes a keel portion having a keel channel provided therein, a pair of opposed chines positioned on opposite sides of the keel portion, a pair of angled panels symmetrically positioned about the keel portion intermediate the keel channel and the pair of opposed chines, and a pair of opposed gunwales extending upward from the pair of opposed chines, wherein each of the pair angled panels has a chine channel provided therein adjacent each chine.

In these respects, the Hydro-Lift Boat Hull according to the present invention substantially departs from the conventional concepts and designs of the prior art, and in so doing provides an apparatus primarily developed for the purpose of offering greater stability and higher speeds.

SUMMARY OF THE INVENTION

In view of the foregoing disadvantages inherent in the known types of boat hulls now present in the prior art, the present invention provides a new Hydro-Lift Boat Hull construction wherein the same can be utilized for offering greater stability and higher speeds.

The general purpose of the present invention, which will be described subsequently in greater detail, is to provide a new Hydro-Lift Boat Hull apparatus and method which has many of the advantages of the boat hulls mentioned heretofore and many novel features that result in a new Hydro-Lift Boat Hull which is not anticipated, rendered obvious, suggested, or even implied by any of the prior art boat hulls, either alone or in any combination thereof.

To attain this, the present invention generally comprises a keel portion having a keel channel provided therein, a pair of opposed chines positioned on opposite sides of the keel portion, a pair of angled panels symmetrically positioned about the keel portion intermediate the keel channel and the pair of opposed chines, and a pair of opposed gunwales extending upward from the pair of opposed chines, wherein each of the pair angled panels has a chine channel provided therein adjacent each chine.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Hydro-Lift Boat Hull apparatus and method which has many of the advantages of the boat hulls mentioned heretofore and many novel features that result in a new Hydro-Lift Boat Hull which is not anticipated, rendered obvious, suggested, or even implied by any of the prior art boat hulls, either alone or in any combination thereof.

It is another object of the present invention to provide a new Hydro-Lift Boat Hull which may be easily and efficiently manufactured and marketed.

It is a further object of the present invention to provide a new Hydro-Lift Boat Hull which is of a durable and reliable construction.

An even further object of the present invention is to provide a new Hydro-Lift Boat Hull which is susceptible of a low cost of manufacture with regard to both materials and labor, and which accordingly is then susceptible of low prices of sale to the consuming public, thereby making such Hydro-Lift Boat Hull economically available to the buying public.

Still yet another object of the present invention is to provide a new Hydro-Lift Boat Hull which provides in the apparatuses and methods of the prior art some of the advantages thereof, while simultaneously overcoming some of the disadvantages normally associated therewith.

Still another object of the present invention is to provide a new Hydro-Lift Boat Hull for offering greater stability and higher speeds.

Yet another object of the present invention is to provide a new Hydro-Lift Boat Hull which includes a keel portion having a keel channel provided therein, a pair of opposed chines positioned on opposite sides of the keel portion, a pair of angled panels symmetrically positioned about the keel portion intermediate the keel channel and the pair of opposed chines, and a pair of opposed gunwales extending upward from the pair of opposed chines, wherein each of the pair angled panels has a chine channel provided therein adjacent each chine.

Still yet another object of the present invention is to provide a new Hydro-Lift Boat Hull that lowers fuel consumption, provides a softer ride, reduces drag, and reduces wave wake.

Even still another object of the present invention is to provide a new Hydro-Lift Boat Hull that can be used in shallow water and can be used with air-drive systems.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
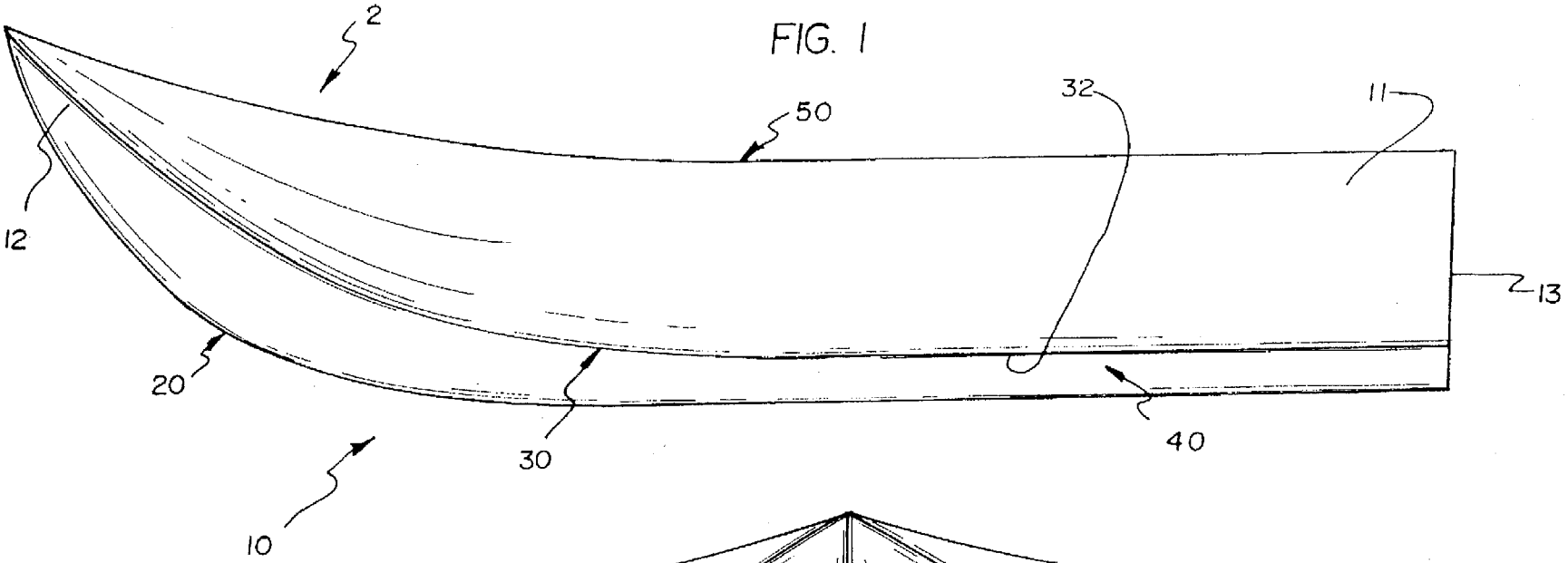
FIG. 1 is a side view of a new Hydro-Lift Boat Hull according to the present invention.

With reference now to the drawings, and in particular to FIGS. 1 through 7 thereof, a new Hydro-Lift Boat Hull embodying the principles and concepts of the present invention and generally designated by the reference numeral 10 will be described.

More specifically, it will be noted that the Hydro-Lift Boat Hull 10 comprises a keel portion 20 having a keel channel 22 provided therein, a pair of opposed chines 30 positioned on opposite sides of the keel portion 20, a pair of angled panels 40 symmetrically positioned about the keel portion 20 intermediate the keel channel 22 and the pair of opposed chines 30, and a pair of opposed gunwales 50 extending upward from the pair of opposed chines 30, wherein each of the pair angled panels 40 has a chine channel 44 provided therein adjacent each of the pair of opposed chines 30.

Figure 2:
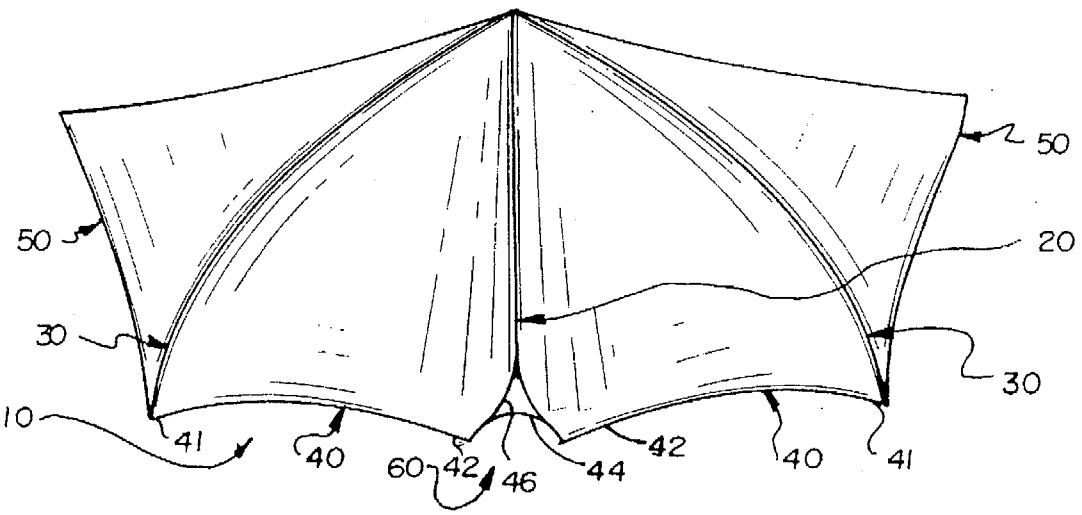
FIG. 2 is a front view of the present invention.
Figure 3:
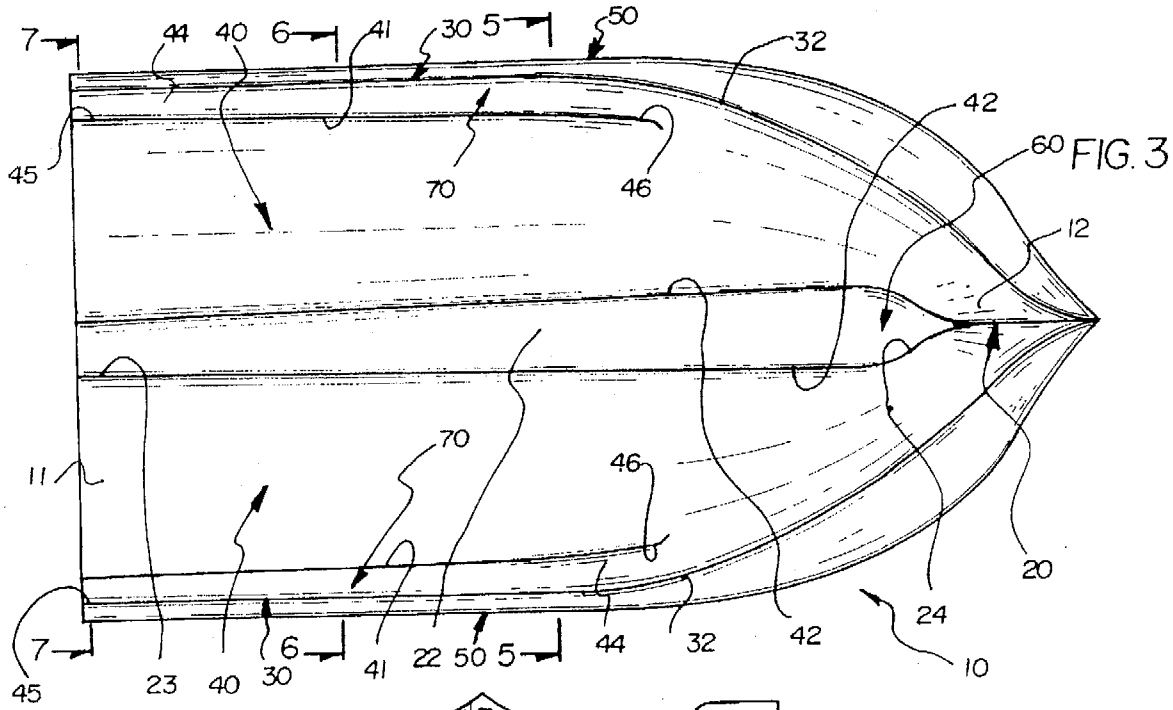
FIG. 3 is a bottom view of the present invention.
Figure 4:
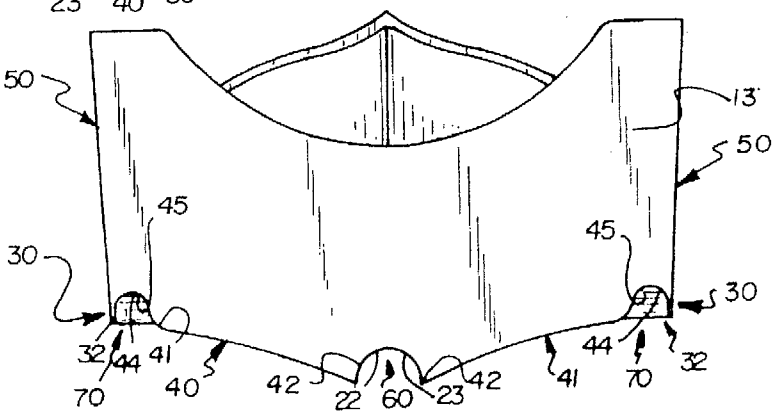
FIG. 4 is a rear view of the present invention.
Figure 5:
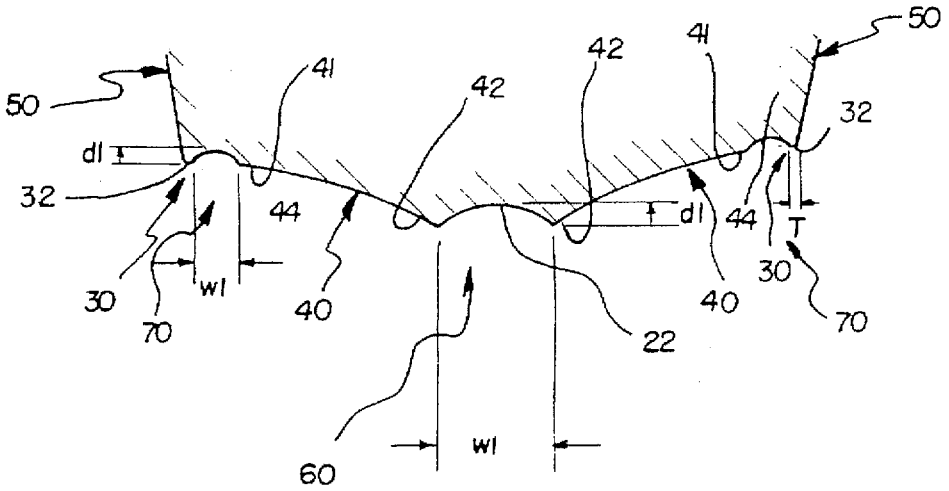
FIG. 5 is a cross sectional view taken along line 5—5 of FIG. 3.
Figure 6:
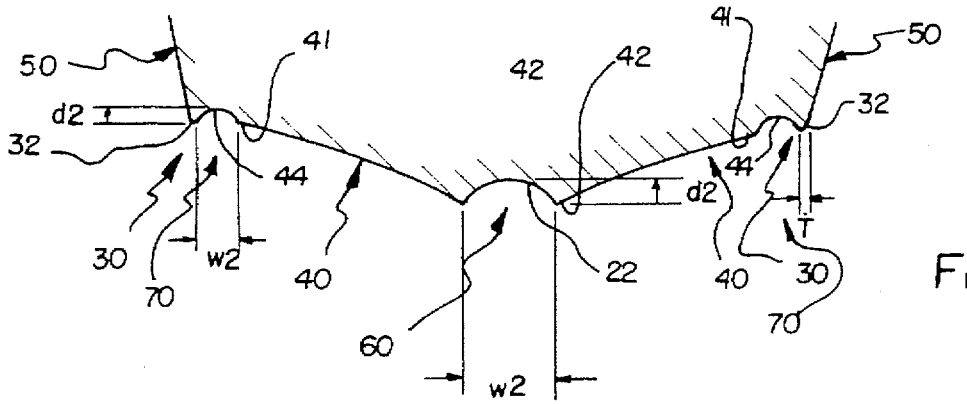
FIG. 6 is a cross sectional view taken along line 6—6 of FIG. 3.
Figure 7:
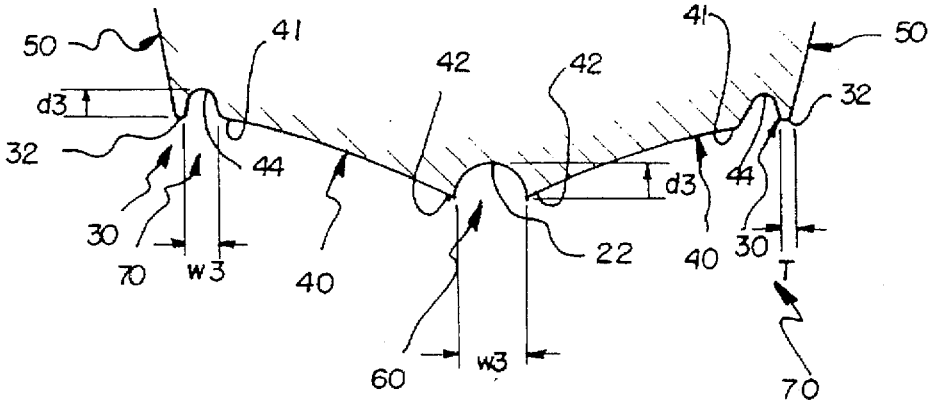
FIG. 7 is a cross sectional view taken along line 7—7 of FIG. 3.

As best illustrated in FIGS. 2 through 4, it can be shown that the keel channel 22 is provided along a center line of the keel portion 20 and extends substantially from the stern 11 of the hull 10 to the bow 12. The keel channel 22 has a rear end 23 and a front end 24. The rear end 23 and the front end 24 are open, wherein the rear end 23 is open to the transom 13 of the hull 10. The keel channel 22 has an inverted U-shaped cross-section and has a width W and a depth D. As best illustrated in FIGS. 5 through 7, it can be shown that the keel channel 22 is tapered over a length thereof from the front end 24 to the rear end 23, whereby the width W of the keel channel 22 at the rear end 23 is less than the width W of the keel channel 22 at the front end 24 such that $W_1>W_2>W_3$ and whereby the depth D of the keel channel 22 at the rear end 23 is greater than the depth D of the keel channel 22 at the front end 24 such that $D_1<D_2<D_3$.

As best illustrated in FIGS. 2 through 4, it can be shown that the pair of opposed chines 30 positioned on opposite sides of the keel portion 20 extend substantially from the stern 11 of the hull 10 to the bow 12. Each of the pair of opposed chines 30 includes a base portion 32 having a thickness T. The base portion 32 is tapered over a length thereof from the stern 11 of the hull 10 toward the bow 12, whereby the thickness T of the base portion 32 at the stern 11 is greater than the thickness T at the bow 12.

As best illustrated in FIGS. 2 through 4, it can be shown that each of the pair of angled panels 40 has an upper edge 41 and a lower edge 42, wherein the lower edge 42 is adjacent the keel channel 22 and the upper edge 41 is adjacent the chine channels 44. Each of the pair of angled panels 40 has a concave arcuate shape.

As best illustrated in FIGS. 3 and 4, it can be shown that the chine channel 44 provided in each of the pair of angled panels 40 is provided adjacent the upper edge 41 thereof. The chine channel 44 extends substantially from the stern 11 toward the bow 12 to beyond a midpoint of the hull 10. The chine channel 44 has a rear end 45 and a front end 46. The rear end 45 and the front end 46 are open, wherein the rear end 45 is open to the transom 13 of the hull 10. The chine channel 44 has an inverted U-shaped cross-section and has a width w and a depth d. As best illustrated in FIGS. 5 through 7, it can be shown that the chine channel 44 is tapered over a length thereof from the front end 46 to the rear end 45, whereby the width w of the chine channel 44 at the rear end 45 is less than the width w of the chine channel 44 at the front end 46 such that $w_1>w_2>w_3$ and whereby the depth d of the chine channel 44 at the rear end 45 is greater than the depth d of the chine channel 44 at the front end 46 such that $d_1<d_2<d_3$.

In operation, the lower edge 42 of each of the pair of angled panels 40 provided adjacent the keel channel 22 extends into the water surface, whereby the pair of angled panels 40 and the keel channel 22 define a water capturing keel tunnel 60. The water capturing keel tunnel 60 captures water, compresses the water, and forms a keel "rail" of water upon which the hull 10 travels when the boat 2 is operated. The keel rail of water applies a lift force to the hull 10 of the boat 2.

In operation, the base portion 32 of each of the pair of opposed chines 30 extends into the water surface, whereby the pair of opposed chines 30 and the chine channels 44 define a pair of opposed water capturing chine tunnels 70. The pair of opposed water capturing chine tunnels 70 capture water, compress the water, and form a pair of opposed chine "rails" of water upon which the hull 10 travels when the boat 2 is operated. The pair of opposed chine rails of water apply lift forces to the hull 10 of the boat 2.

In use, the base portion 32 of each of the pair of opposed chines 30 extends into the water surface. As the boat 2 is operated, the hull 10 diverts water into the water capturing keel tunnel 60 and the pair of opposed water capturing chine tunnels 70 to form a keel "rail" of water and a pair of opposed chine "rails" of water, respectively, upon which the hull 10 travels. Since the keel channel 22 is tapered over a length thereof from the front end 24 to the rear end 23, the water capturing keel tunnel 60 is also tapered whereby the water captured in the water capturing keel tunnel 60 is compressed and subjected to increased pressure as the water travels from the front end 24 of the keel channel toward the rear end 23 thereby forming a keel rail of compressed and pressurized water upon which the hull 10 travels. Since the chine channels 44 are tapered over a length thereof from the front end 46 to the rear end 45, the pair of opposed water capturing chine tunnels 70 are also tapered whereby the water captured in the pair of opposed water capturing chine tunnels 70 is compressed and subjected to increased pressure as the water travels from the front end 46 of the chine channels 44 toward the rear end 45 thereby forming a pair of opposed chine rails of compressed and pressurized water upon which the hull 10 travels. The keel "rail" of water and the pair of opposed chine "rails" of water apply a lift force to the hull 10 of the boat 2 thus improving the performance and operation of the boat 2, including greater stability, higher speeds, lower fuel consumption, softer ride, reduced drag, and reduced wave wake.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hull for a boat adapted for use on a water surface, said hull having a bow, a stern, and a transom, comprising:

a keel portion having a keel channel provided therein along a center line of said keel portion, said keel channel extending substantially from said stern to said bow, said keel channel having a rear end and a front end, said rear end and said front end being open, said rear end being open to said transom of said hull, said keel channel having an inverted U-shaped cross-section having a width and a depth, said keel channel being tapered over a length thereof from said front end of said keel channel to said rear end, whereby said width of said keel channel at said rear end is less than said width of said keel channel at said front end and whereby said depth of said keel channel at said rear end is greater than said depth of said keel channel at said front end;

a pair of opposed chines positioned on opposite sides of said keel portion, said pair of opposed chines extending substantially from said stern to said bow, each of said pair of opposed chines including a base portion;

a pair of angled panels symmetrically positioned about said keel portion intermediate said keel channel and said pair of opposed chines, each of said pair of angled panels having an upper edge and a lower edge, said lower edge adjacent said keel channel, each of said pair of angled panels having a chine channel provided therein, said chine channel provided adjacent each of said pair of opposed chines and adjacent said upper edge of each of said pair of angled panels, said chine channel extending substantially from said stern toward said bow to beyond a midpoint of said hull, said chine channel having a rear end and a front end, said rear end and said front end being open, said rear end being open to said transom of said hull: and a pair of opposed gunwales extending upward from said pair of opposed chines.

2. The hull of claim 1, wherein said lower edge of each of said pair of angled panels provided adjacent said keel channel extends into said water surface, said pair of angled panels and said keel channel defining a water capturing keel tunnel, said water capturing keel tunnel capturing water, compressing said water, and forming a keel rail of water upon which said hull travels when said boat is operated.

3. The hull of claim 1, wherein said chine channel has an inverted U-shaped cross-section having a width and a depth.

4. The hull of claim 1, wherein said base portion has a thickness and wherein said base portion is tapered over a length thereof from said stern toward said bow, whereby said thickness of said base portion at said stern is greater than said thickness at said bow.

5. The hull of claim 1, wherein each of said pair of angled panels has a concave arcuate shape.

6. The hull of claim 3, wherein said chine channel is tapered over a length thereof from said front end of said chine channel to said rear end, whereby said width of said chine channel at said rear end is less than said width of said chine channel at said front end and whereby said depth of said chine channel at said rear end is greater than said depth of said chine channel at said front end.

7. The hull of claim 6, wherein said base portion of each of said pair of opposed chines extends into said water surface, said pair of opposed chines and said chine channels defining a pair of opposed water capturing chine tunnels, said pair of opposed water capturing chine tunnels capturing water, compressing said water, and forming a pair of opposed chine rails of water upon which said hull travels when said boat is operated.

8. A hull for a boat adapted for use on a water surface, said hull having a bow, a stern, and a transom, comprising:

a keel portion having a keel channel provided therein along a center line of said keel portion, said keel channel extending substantially from said stern to said bow, said keel channel having a rear end and a front end, said rear end and said front end being open, said rear end being open to said transom of said hull;

a pair of opposed chines positioned on opposite sides of said keel portion, said pair of opposed chines extending substantially from said stern to said bow, each of said pair of opposed chines including a base portion;

a pair of angled panels symmetrically positioned about said keel portion intermediate said keel channel and said pair of opposed chines, each of said pair of angled panels having an upper edge and a lower edge, said lower edge adjacent said keel channel, each of said pair of angled panels having a chine channel provided therein, said chine channel provided adjacent each of said pair of opposed chines and adjacent said upper edge of each of said pair of angled panels, said chine channel extending substantially from said stern toward said bow to beyond a midpoint of said hull, said chine channel having a rear end and a front end, said rear end and said front end being open, said rear end being open to said transom of said hull, said chine channel having an inverted U-shaped cross-section having a width and a depth, said chine channel being tapered over a length thereof from said front end of said chine channel to said rear end, whereby said width of said chine channel at said rear end is less than said width of said chine channel at said front end and whereby said depth of said chine channel at said rear end is greater than said depth of said chine channel at said front end; and a pair of opposed gunwales extending upward from said pair of opposed chines.

9. The hull of claim 8, wherein said base portion of each of said pair of opposed chines extends into said water surface, said pair of opposed chines and said chine channels defining a pair of opposed water capturing chine tunnels, said pair of opposed water capturing chine tunnels capturing water, compressing said water, and forming a pair of opposed chine rails of water upon which said hull travels when said boat is operated.

10. The hull of claim 8, wherein said keel channel has an inverted U-shaped cross-section having a width and a depth.

11. The hull of claim 10, wherein said keel channel is tapered over a length thereof from said front end of said keel channel to said rear end, whereby said width of said keel channel at said rear end is less than said width of said keel channel at said front end and whereby said depth of said keel channel at said rear end is greater than said depth of said keel channel at said front end.

12. The hull of claim 11, wherein said lower edge of each of said pair of angled panels provided adjacent said keel channel extends into said water surface, said pair of angled panels and said keel channel defining a water capturing keel tunnel, said water capturing keel tunnel capturing water, compressing said water, and forming a keel rail of water upon which said hull travels when said boat is operated.

13. The hull of claim 8, wherein said base portion has a thickness and wherein said base portion is tapered over a length thereof from said stern toward said bow, whereby said thickness of said base portion at said stern is greater than said thickness at said bow.

14. The hull of claim 8, wherein each of said pair of angled panels has a concave arcuate shape.

* * * * *